US005416821A

United States Patent [19]

Frazier et al.

[11] Patent Number: 5,416,821

[45] Date of Patent: May 16, 1995

[54] GRID FORMED WITH A SILICON SUBSTRATE

[75] Inventors: Edward N. Frazier, Manhattan Beach; Simon Prussin, Los Angeles, both of Calif.

[73] Assignee: TRW Inc., Redondo Beach, Calif.

[21] Appl. No.: 60,000

[22] Filed: May 10, 1993

[51] Int. Cl.[6] ..... G21K 1/00

[52] U.S. Cl. ..... 378/154; 378/210

[58] Field of Search ..... 378/154, 155

[56] References Cited

U.S. PATENT DOCUMENTS

| | | | |
|---|---|---|---|
| 2,605,427 | 7/1952 | Delhumeau | 378/154 |
| 4,158,141 | 6/1979 | Seliger et al. . | |
| 4,523,098 | 6/1985 | Noma . | |
| 4,613,981 | 9/1986 | Siddall et al. . | |
| 4,715,680 | 12/1987 | Kawaguchi . | |
| 4,745,812 | 5/1988 | Amazeen et al. . | |
| 4,825,034 | 4/1989 | Auvert et al. . | |
| 4,885,472 | 12/1989 | Young . | |
| 4,916,285 | 4/1990 | Baur et al. . | |
| 4,945,205 | 7/1990 | Litman et al. . | |
| 4,951,305 | 8/1990 | Moore et al. | 378/154 |
| 4,992,699 | 2/1991 | McClure et al. . | |
| 5,043,586 | 8/1991 | Giuffre et al. . | |
| 5,082,695 | 1/1992 | Yamada et al. . | |
| 5,147,740 | 9/1992 | Robinson . | |
| 5,169,488 | 12/1992 | Giuffre et al. . | |
| 5,231,654 | 7/1993 | Kwasnick et al. | 378/154 |

*Primary Examiner*—Craig E. Church

[57] ABSTRACT

A grid for use in a collimator system for high energy waves such as X-rays and gamma rays includes a silicon base in which slits are etched along multiple separated lines. Located transversely in the slits are tungsten slats. Between the separated lines, silicon is removed by etching. Pairs of grids are longitudinally spaced apart along a longitudinal axis running transversely to the direction of the lines and the slats. Rotating the pair of grids about the longitudinal axis, and providing a detector associated with each grid pair provides for metering high energy rays.

30 Claims, 4 Drawing Sheets

GRID FORMED WITH A SILICON SUBSTRATE

Providing a fine grid with a high degree of accuracy for use on metering structures to detect images of high energy electromagnetic rays is valuable.

This invention relates to a grid for use in detecting images of high energy electromagnetic waves, such as X-rays and gamma rays. In order to obtain precise imagery of such rays, particularly when the intensity of such rays is relatively low, it is essential to have a finely spaced grid with a pitch of about 100 micron between absorbing elongated elements. Each of the elements located in the grid must be spaced apart with an accuracy of about 10 micron.

It has not been possible, to date, to provide a grid with such a degree of accuracy. By this invention, there is provided means and technique for providing such a grid.

SUMMARY

This invention seeks to provide a grid for use in collimating high energy electromagnetic waves such as X-rays and gamma rays. The elements forming the grids can be spaced apart with a very fine pitch and with a high degree of accuracy.

According to the invention, there is provided a grid comprising a substrate formed of a first element having at least one line, and preferably multiple separated lines, with spaced slits. The slits are formed by etching material from the first element. An aperture is etched in the substrate. Multiple elongated second elements are located in spaced relationship transversely between aligned slits in the separated lines.

Preferably, the material from which the separated lines is formed is removed by etching. The material being the substrate about the ends of the lines provides a periphery for securing the lines separately relative to each other. At least part of the material of the periphery has etched slits. The periphery forms at least part of the lines of the grid for securing the second elements in spaced relationship.

In a preferred form of the invention, the slits have a width of about 25 micron, and a depth of about 2,500 micron. The pitch between adjacent slits is about 100 micron. Each slit preferably includes a mouth of a width greater than the width of the slit, the width of the mouth being about 35 micron.

In yet a further preferred form of the invention, the substrate is a silicon based material, and etching is affected with the silicon crystals selectively in the <110> orientation. The second material is selectively a relatively high Z material, and is preferably tungsten or lead. The second material is of about 25 micron thickness and can be about 3,500 micron width, the material is cut to such width by laser action, and the width can be 2,500 micron which fits within the slot depth.

Multiple grids can be located relatively spaced apart along a longitudinal axis, such longitudinal axis being defined as being transverse to the lines and the second element. The grids can be selectively rotatable about a central longitudinal axis. Multiple grids can be located on planar structures spaced apart longitudinally. Each planar structure can have multiple grids at relatively different orientations of the first elements.

The invention is now further described with reference to the accompanying drawings.

DRAWINGS

FIG. 1 is a plan view of a single grid illustrating five separated lines with slits located within a periphery. The periphery is part of the lines. Multiple transverse slats are shown in the slits.

DESCRIPTION

First Element-Silicon

Figures 1, 2, 3:
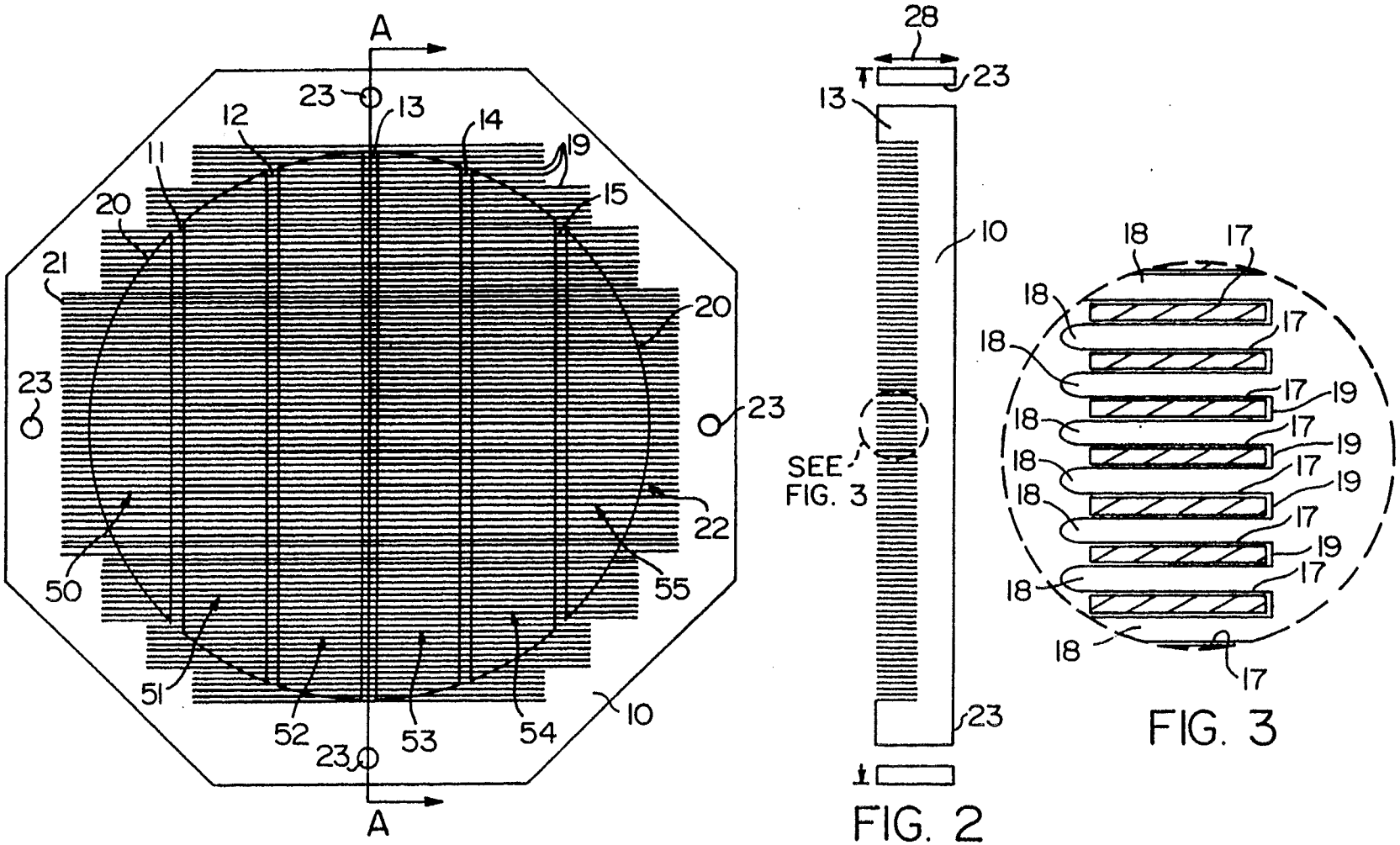
FIG. 2 is a cross-sectional side view of a central line of slits along A—A of FIG. 1. The depth relative to width is not shown to scale.
FIG. 3 is an enlarged side view of a portion of FIG. 2 illustrating the first material forming the slits and a cross-section of the second material forming the slats transversely located in the slits.
Figure 4:
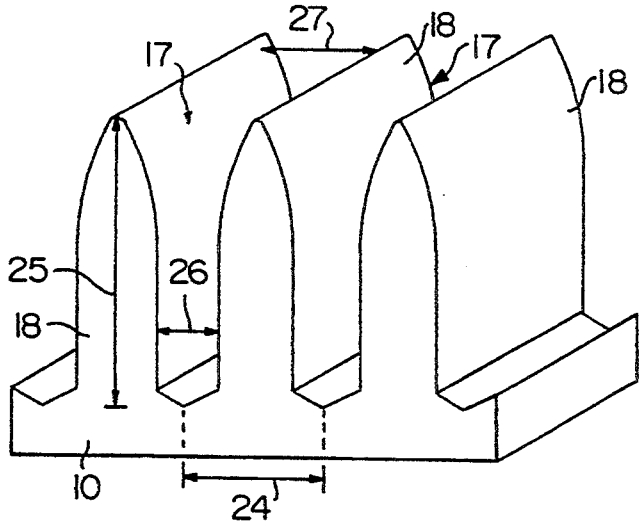
FIG. 4 is a perspective view illustrating a detail of the teeth between each of the slits of each line. The depth relative to width of the slits are not shown to scale.

A solid silicon based material 10 is set up in the <110> crystallographic orientation as a first element. With the silicon crystal cut along the <110> plane, an hexahedral column of space is defined by the silicon atoms and their associated interatomic bonds. The <110> crystal orientation results in an etching rate directly into the crystal that is more than 100 times higher than the rate in the transverse direction. This property of the crystal allows very deep slits to be etched without those slits being unnecessarily broadened by etching at the walls of the slits.

The silicon structure 10 is a substrate forming a first element having multiple spaced lines 11, 12, 13, 14, and 15. In each of these lines there are spaced slits 17. Silicon material 18 is located between each of the slits 17.

The respective lines 11, 12, 13, 14, and 15 have ends which are integrally formed into the area of the periphery 20 in the substrate body 10. Slits 17 are also constituted in and beyond the periphery area 20. Thus the zone about the periphery 20 is also to be considered as forming part of the lines in the first element. For instance, as illustrated in FIG. 1, the zone 21 and zone 22, respectively outside of lines 11 and 15, are to be considered as transverse lines having slits 17 for receiving the second elements 19.

Each slit 17 is formed by micromachining the silicon material constituting the solid silicon 10 by an etching process. A regularly spaced and highly accurate set of slits is created around the periphery 20 supplementing the lines 11 through 15 across the periphery 20. Between each of the lines 11, 12, 13, 14, and 15 and the periphery 20, the silicon is removed by etching. Apertures 50, 51, 52, 53, 54 and 55 are thereby formed inside of the periphery 20. The lines 11 through 15 are located between the apertures.

The pitch between each of the slits 17 is about 100 micron as indicated by arrow 24 which is directed to the center of each slit. The depth of each slit is about 2,500 micron as indicated by arrow 25. The width of each slit 17 is about 25 micron as indicated by arrow 26. Each slit 17 includes a mouth as indicated by arrow 27, such mouth has a width of about 35 micron. The ratio of the depth 25 to the width 26 should be at least as great as about 100:1.

The dimensions of the grid as illustrated in the Figures would be about 4"×4" across, as illustrated in FIG. 1, between top and bottom and side-to-side. As illustrated in FIG. 2, the depth 28 would be about ¼".

Beyond the slits 17 and outside the periphery 20, the silicon includes apertures 23 longitudinally directed in a direction transverse to the direction of the lines 11 to 15. The apertures 23 are arranged for locating each grid on a foundation member as necessary.

Second Element-Metal

Transversely located across each of the respective lines 11, 12, 13, 14, and 15 are multiple elongated second elements or slats 19. These are located in each of the respective slits 17 aligned in adjacent lines. Each of the slits 17 and each of the respective lines 11, 12, 13, 14, and 15 are aligned relative with each other so that the transverse second elements 19 can be located parallel with each other with a high degree of accuracy.

The second element is a high Z material for absorbing high energy electromagnetic waves such as X-rays or gamma rays and can be selectively tungsten or lead. "Z" indicates the number of protons and neutrons of the material (e.g. $U^{235}$). The tungsten or lead slats are laser formed of a precise width which fits into the depth of each slit 17.

Fabricating the Silicon Substrate

The procedure for fabricating a silicon structure with the spaced lines across an aperture is now described.

Cut 4"×4" of ¼" thickness <110> ingot 80 from a 4" length of a standard <111> silicon cylindrical boule 81. Such boules 81 are readily available from all the major silicon producers. The blank 80 is cut and lapped carefully to achieve a substrate 10 with the <110> orientation, and it is polished to assure an adherent $Si_3N_4$ free of pinholes.

$Si_3N_4$ CVD coating is deposited on both sides of the silicon blank. To assure sufficient protection during the 100 mil deep etching of the slits 17, a $Si_3N_4$ coating 2,500 Å thick is deposited. Plasma enhanced CVD deposition is used to reduce possible stress problems in the coating.

Spin on standard positive photo-resist, AZ1350 (Hoechst Celanese, Summerville, N.J.) at 5000 rpm as a deposit. After spin-on, the blank is soft baked at 90° C. to drive off solvents in the photo-resist.

In order for the slits 17 to be straight and parallel across the face of the 4" ingot, these slits 17 must be parallel to the <111> crystal planes. This <111> plane extends perpendicular to and inwardly of the <110> plane 84. To accomplish this, an alignment pattern 82 consisting of a fan pattern of short straight lines 83 is etched into the <110> face 84 of the blank 80 to reveal the exact orientation of the <111> crystal planes. Only one line 85 out of this fan pattern will be straight because it will be aligned with the <111> crystal plane. Other lines 83 will be jagged. The correctly oriented line 85 establishes the direction for all of the slits 17. An alignment mask is aligned on the blank 80 with a contact printer and exposed. The photo-resist is developed by immersion in a KOH solution in a beaker. After a hard bake at 125° C., the silicon blank is subjected to standard plasma etching of the $Si_3N_4$. This is followed by standard strip of the residual photo-resist in acetone. The orientation grooves can now be etched by an hour immersion in standard KOH etch. This etches to a depth of 50 μm.

A tape of the pattern of slits 17 is generated on a CAD system. This tape is then sent out to a standard mask house for conversion. Similarly, a mask defining the open sections 50 to 55 of the silicon metering structure is generated. This is used on the back side of the blank of the substrate 10. This procedure allows the two different patterns, the slits 17 and apertures 50 through 55, to be etched in one step.

The slit patterns 17 are generated in a multistep process:

a. Clean the blank substrate 10.
b. Deposit $Si_3N_4$ CVD coating on both front and back surfaces.
c. Deposit photo-resist on both the front and the back surfaces and soft bake.
d. Expose the slit pattern on the top surface, using previously generated alignment slots.
e. Develop photo-resist and subject to hard bake.
f. Subject to plasma etching of $Si_3N_4$ on the top surface.
g. Strip photo-resist and clean.
h. Repeat steps c through g on the back surface, using the back side mask.

To etch the deep grooves of the slits 17, etching conditions which maximize the ratio of the etching rates on the <110> and the <111> surfaces are used. This is achieved by using a 55% concentration of KOH etchant at a temperature of 85° C. In 50 hours, this etches a groove for slits 17 that is 2,500 micron deep that is 25 micron wide at the bottom and 35 micron wide at the top.

Fabricating the Tungsten Slats

The procedure for forming the second element is now described.

Tungsten sheets with a thickness of approximately 25 micron are required. These sheets are uniform in thickness to an accuracy of about 1%. The absolute thickness of the sheets need only be accurate to approximately 10%, because the design of the silicon grid pattern can be adjusted slightly to accommodate a different thickness. Tungsten sheets meeting these specifications can be procured from commercial vendors.

The laser cutting pattern cuts approximately 1,250 individual tungsten slats, each 1235 mm long and 3,000 micron wide, out of the tungsten sheets. This pattern is entered into the computer which controls the laser cutter.

A $CO_2$ laser with a power of 20 watts is sufficient to perform the cutting. A laser spot diameter of 100 to 125 micron on the tungsten sheet is typical, but not critical. It is critical to avoid localized heating which would result in burrs. This is done by maintaining a sufficiently high cutting speed, at least 15 to 20 meters per minute.

The individual tungsten slats are then individually placed into the slits formed in the silicon metering structure.

As so formed, a grid is provided for use in a high-energy electromagnetic wave metering device.

Space Borne Astronomical Metering Device

Figure 5:
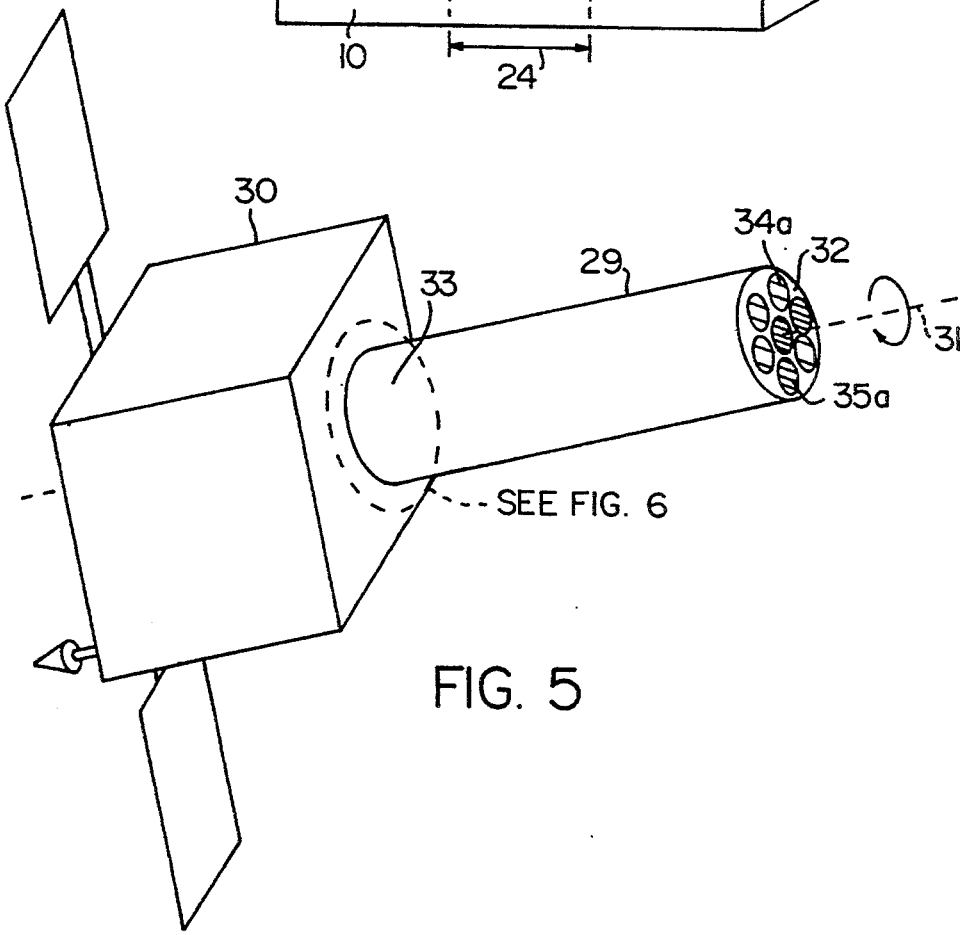
FIG. 5 is a diagrammatic illustration of a space borne craft having a first planar structure with multiple grids spaced longitudinally from a second planar structure having multiple grids. Detector means associated with the grids are arranged longitudinally, there being a detector for each pair of grids along each respective longitudinal axis for each pair of grids arranged longitudinally.

As illustrated in FIG. 5, a use of each of the grids as illustrated and described in FIG. 1 can be in a space borne astronomical experiment.

Each of the grids of FIG. 1 can be arranged with different orientations in a first planar structure on the fore end of a cylindrical device 29 mounted to a body 30 of a spacecraft. There is shown a longitudinal axis 31 through the cylinder 29. On the forward end 32 of the cylinder 29, there is shown seven grid elements arranged about a central longitudinal axis 31. Each of the seven grids has a respective longitudinal axis parallel to axis 31.

Figure 6:
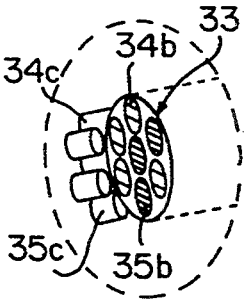
FIG. 6 is a detail of the grids located at the aft end of a cylinder with high energy detectors located behind each aft grid.

As indicated in FIG. 6, the pitch of the tungsten slats 19 is different for different grids in the space at the forward end 32 of cylinder 29. Similarly, at the aft portion 33 of the cylinder 29, there are located multiple grids in mating orientations relative to the grids on the forward end 32. The grid at the aft is mounted on the second planar structure.

Thus, for instance, grid 34*a* in the forward end 32 is identical to grid 34*b* in the aft end 33 in their respective orientations. Behind grid 34*b* is a detector 34*c*. Similarly, for instance, grid 35*a* in the forward end 32 is identical to grid 35*b* in the aft end 33 and there is the detector 35*c* behind the grid 35*b*.

The spacecraft 30 points to the sun so that the cylinder 29 is directed towards the sun. Through the detecting means constituted by elements 34*c* and 35*c* and other associated detectors behind the respective aft end 33, images of solar regions emitting high energy X-rays and gamma rays can be determined.

The fine grids are arranged in carefully aligned pairs separated by a distance of several meters by the length of the cylinder 29. The slats in each grid pair 34*a* and 34*b*, respectively, relative to 35*a* and 35*b*, respectively, have different pitches. As the spacecraft rotates about the central axis 31, data from all the detectors 34*c*, 35*c* and other detectors can be combined to reconstruct a gamma ray image or X-ray image of the sun.

Terrestrial Metering Device

Figure 7:
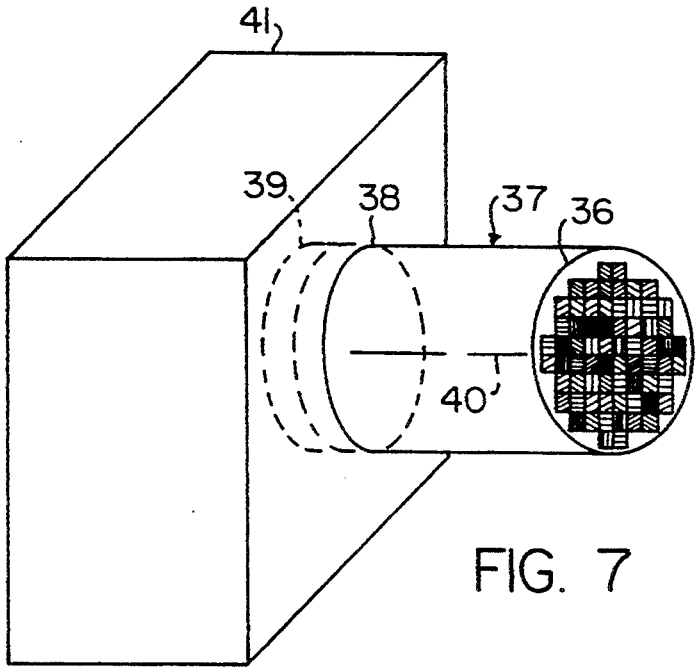
FIG. 7 is an illustration of a planar structure showing multiple grids located adjacent each other, the grids are located at a forward end of a cylinder and at an aft end with respective detectors adjacent the aft end.
Figure 8:
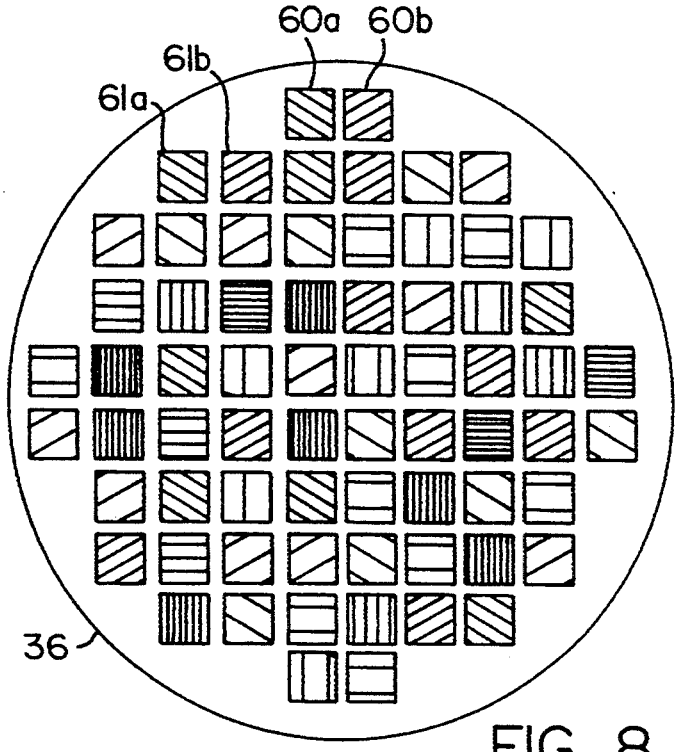
FIG. 8 is a plan view of a planar structure and illustrating multiple grids arranged adjacently and with the grids having different orientations of the separated lines.
Figure 9:
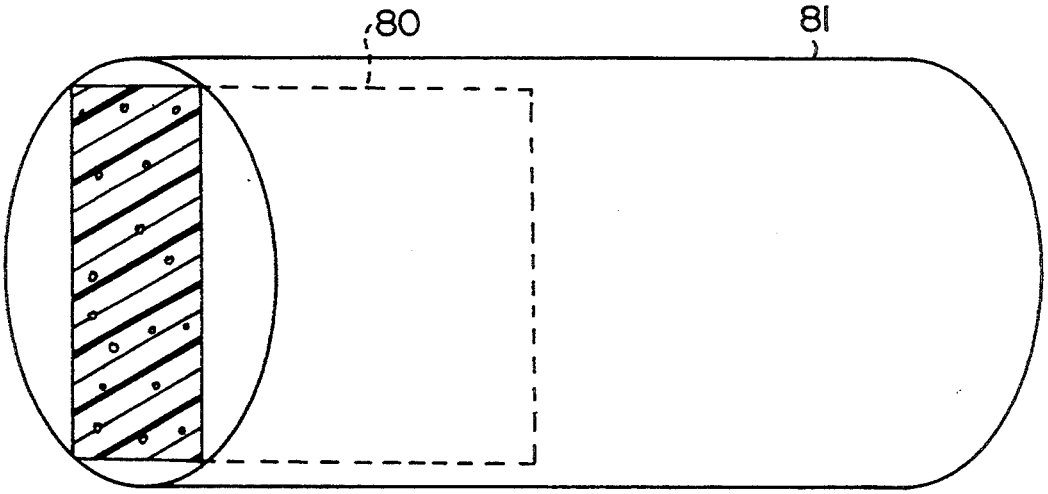
FIG. 9 is a perspective view of a boule indicating the <110> ingot to be cut from the boule.
Figure 10:
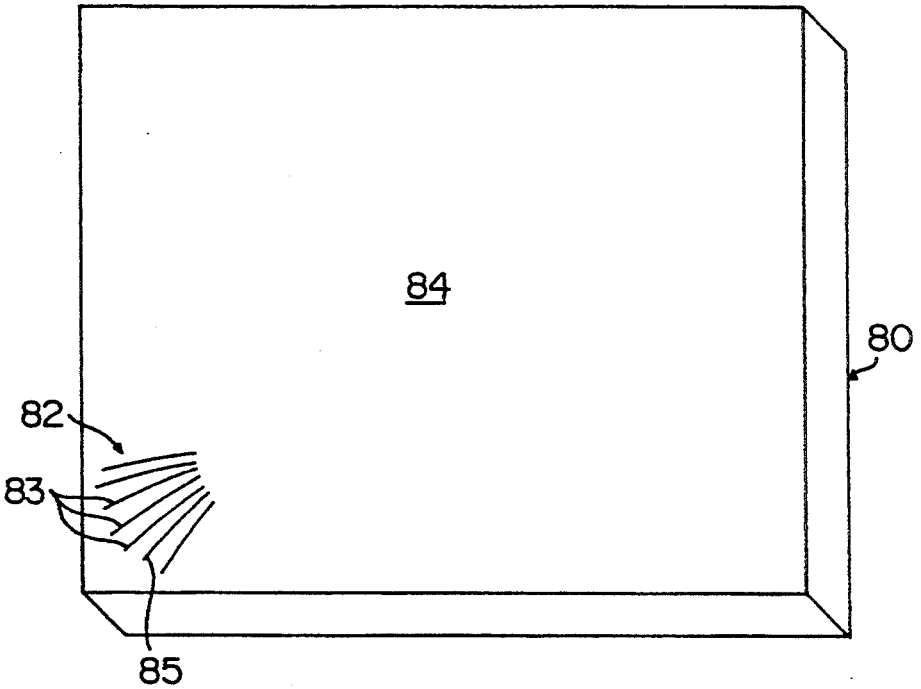
FIG. 10 is a perspective view of an ingot showing the orientation lines and crystal structure.

As illustrated in FIGS. 7 and 8, the fine grid illustrated in FIG. 1 can be used for the determination of radiation distribution of, e.g., nuclear power plant equipment or contamination plumes. These can be effectively and quickly mapped out by imaging the gamma radiation from a distance, rather than by detailed probing with a Geiger counter.

The fine grids of FIG. 1 are used with multiple small grid pairs employed as indicated by numerals 60*a* and 60*b* respectively, and 61*a* and 61*b* respectively. Other grid pairs are arranged in the planar structure at the forward end 36. The grids are located in a forward end 36 of a cylinder 37. Similar grids are located in the aft end 38 of the cylinder 37. Behind the aft end 38 is a detecting panel 39 with a detector corresponding to each of the respective grid pairs formed between a grid in the forward structure 36 and a mating grid in the aft structure 38.

A central longitudinal axis 40 is illustrated between the front 36 of the cylinder 37 and the rear 38 of the cylinder 37. Multiple longitudinal axis parallel to axis 40 are provided for each respective grid pair in the front and respective rear of the cylinder 37. Selective grid pairs in the front and rear have different orientations relative to adjacent pairs in the respective planar structures in the aft and forward positions.

The grids in each of the forward and aft positions can selectively have different pitches as is illustrated by the different thickness of lines and width of spacing between lines as shown in FIG. 8. FIG. 8 represents multiple different orientations and multiple different pitches for the grid arrangement in the forward structure 36 of the metering device 37. The cylinder 37 is mounted a support base or housing 41 which contains the detectors 39. In such an embodiment, the cylindrical tube 37 is relatively stationary, namely no rotation about axis 40 is necessary. Tube 37 can be relatively shorter than the tube illustrated in the space borne application of FIG. 5. The instrument could be mobile, and can be aimed at a target while being transported on a truck, plane or the like.

General

Many other forms of the invention exist, each differing from others in matters of detail only. Although the invention has been described with reference to an imaging device, other applications of the grid can be employed. Thus, the collimator grid may be used in diagnostic and therapeutic X-ray devices for medical purposes. The extreme metric accuracy obtained by using a solid block of micromachined silicon, where the machining is affected by etching, provides useful advantages. The absorption of unwanted X-rays performed by highly, accurately and individually cut tungsten slats located in the slits provides for an accurate grid structure. The position or accuracy of the tungsten slats within the slits can be better than about 1 .micron. The grid can be used in multiple devices seeking to image high-energy electromagnetic waves such as X-rays and gamma rays.

The invention is considered to be defined solely in terms of the following claims.

We claim:

1. A grid apparatus for collimating electromagnetic waves, comprising:

(a) a substrate having a face surface, a plurality of spaced parallel slits being formed into the substrate from the face surface; and (b) a plurality of slats supported in corresponding ones of the slits for selectively blocking the electromagnetic waves, the substrate being formed with an aperture extending therethrough for enhancing passage of electromagnetic wave portions that are not blocked by the slats, the slats extending within the aperture.

2. The grid apparatus of claim 1, wherein the substrate is crystalline, the face surface being planar in <110> crystal orientation, the slits being parallel to <111> crystal planes of the substrate.

3. The grid apparatus of claim 1, wherein the substrate is formed of a first material having an atomic weight less than Z for permitting passage of at least a portion of the electromagnetic waves, the slats being formed of a second material having an atomic weight greater than Z.

4. The grid apparatus of claim 3, wherein the first material comprises silicon.

5. The grid apparatus of claim 3, wherein the second material is selected from the group consisting of tungsten and lead.

6. The grid apparatus of claim 5, wherein the first material comprises silicon and the face surface is in <110> crystal orientation.

7. The grid apparatus of claim 1, wherein the slats have a thickness of approximately 25 microns, the slits having a pitch of approximately 100 microns.

8. The grid apparatus of claim 7, wherein the slits have a depth of at least approximately 2,500 microns.

9. The grid apparatus of claim 7, wherein the slits have a depth between approximately 2,500 microns and approximately 3,500 microns.

10. The grid apparatus of claim 7, wherein the slits have a depth of approximately 3,000 microns.

11. The grid apparatus of claim 7, wherein the slats are situated within the slits.

12. The grid apparatus of claim 7, wherein each of the slits has a depth and a width of approximately 25 microns within a major portion of the depth.

13. The grid apparatus of claim 12, wherein each of the slits is formed with a mouth portion extending into the substrate from the face surface, the mouth portion having a width of approximately 35 microns.

14. The grid apparatus of claim 1, each of the slats being supported in pairs of the slits extending in axial alignment from opposite sides of the aperture, the members of the pairs forming corresponding lines of the slits on opposite of the aperture.

15. The grid apparatus of claim 1, wherein the aperture is a first aperture, the substrate also having a second aperture formed therein, respective lines of the slits being formed on opposite sides of the apertures and between the apertures, at least some of the slats being supported in three of the slots.

16. The grid apparatus of claim 1, the aperture being one of a plurality of apertures, spaced lines of the slits extending across the substrate between adjacent ones of the apertures.

17. The grid apparatus of claim 16, including at least three of the spaced lines.

18. The grid apparatus of claim 16, wherein the slits are approximately transversely oriented relative to the lines.

19. A grid apparatus comprising at least two sets of slits are enclosed by a periphery area of the substrate, the apertures collectively defining an aperture area within the periphery area.

20. The grid apparatus of claim 19, wherein the substrate has a thickness of approximately 0.25 inch and a transverse dimension of at least approximately 4 inches.

21. The grid apparatus of claim 19, wherein the aperture area is approximately circular.

22. The grid apparatus of claim 21, wherein the aperture area is approximately circular.

23. A grid apparatus for collimating electromagnetic waves, comprising:

(a) a substrate formed of a first material having an atomic weight less than Z for permitting passage of at least a portion of the electromagnetic waves, a plurality of spaced parallel slits being formed in the substrate; and (b) a plurality of slats formed of a second material having an atomic weight greater than Z, the slats being supported in corresponding ones of the slits for selectively blocking the electromagnetic waves, the substrate having an aperture formed therein for enhancing passage of the electromagnetic waves, at least some of the slits and corresponding ones of the slats extending in axial alignment on opposite sides of the aperture.

24. A grid apparatus comprising at least two sets of slats supported in slits, each of the sets being as claimed in claim 23, the sets being spaced apart on a longitudinal axis, the longitudinal axis defining a direction transverse to the slats, the slats of each set being proximately parallel to each other thereby for metering the electromagnetic waves.

25. The grid apparatus of claim 24, further comprising a detector for detecting electromagnetic waves passing through both sets of the slats.

26. A method for collimating electromagnetic waves, comprising the steps of:

(a) providing a substrate, the substrate being capable of passing at least a portion of the electromagnetic radiation, the step of providing the substrate including forming an aperture in the substrate for passing the electromagnetic radiation;

(b) forming spaced slits in the substrate; and (c) supporting slats in corresponding ones of the slits, the slats being spaced for blocking selected portions of the radiation; and (d) orienting the substrate facing a source of the radiation, thereby collimating the radiation.

27. The method of claim 26, wherein the step of providing the substrate includes selecting a material for the substrate that is capable of transmitting the portion of the radiation.

28. A method for collimating and metering electromagnetic waves, comprising the steps of:

(a) providing a first substrate, the first substrate being capable of passing at least a portion of the electromagnetic radiation;

(b) forming spaced slits in the first substrate;

(c) supporting slats in corresponding ones of the slits, the slats being spaced for blocking selected portions of the radiation;

(d) orienting the substrate facing a source of the radiation, thereby collimating the radiation;

(e) providing a second substrate;

(f) forming spaced slits in the second substrate;

(g) supporting counterparts of the slats in corresponding slits of the second substrate; and (h) spacing the substrates along a longitudinal axis with the respective slats transversely oriented relative to the longitudinal axis and substantially parallel to each other for metering the electromagnetic waves.

29. The method of claim 28, comprising the further step of locating the slats in separate corresponding grid groups on each of the first and second substrates, the slats of each group having different combinations of features selected from the group consisting of a pitch spacing of the slats and an angular orientation of the slats.

30. A method for collimating, metering and signalling electromagnetic waves, comprising the steps of:

(a) providing a first substrate, the first substrate being capable of passing at least a portion of the electromagnetic radiation;

(b) forming spaced slits in the first substrate;

(c) supporting slats in corresponding ones of the slits, the slats being spaced for blocking selected portions of the radiation;

(d) orienting the substrate facing a source of the radiation, thereby collimating the radiation;

(e) providing a second substrate;

(f) forming spaced slits in the second substrate;

(g) supporting counterparts of the slats in corresponding slits of the second substrate;

(h) spacing the substrates along a longitudinal axis with the respective slats transversely oriented relative to the longitudinal axis and substantially parallel to each other for metering the electromagnetic waves; and (i) locating a detector in association with slats of the second substrate for signalling portions of the electromagnetic waves passing through the slats of the first and second substrates.

* * * * *